US009826869B2

(12) United States Patent
Kettle Aiers et al.

(10) Patent No.: US 9,826,869 B2
(45) Date of Patent: Nov. 28, 2017

(54) SUCTION NOZZLE FOR A VACUUM CLEANER

(71) Applicant: Dyson Technology Limited, Wiltshire (GB)

(72) Inventors: Reuben Thomas Daniel Lawrence Kettle Aiers, Birmingham (GB); Matthew John Dobson, Gloucester (GB); Stephen Robert Dimbylow, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 70 days.

(21) Appl. No.: 15/061,172

(22) Filed: Mar. 4, 2016

(65) Prior Publication Data

US 2016/0256024 A1 Sep. 8, 2016

(30) Foreign Application Priority Data

Mar. 6, 2015 (GB) ..... 1503858.1

(51) Int. Cl.
*A47L 9/02* (2006.01)
*A47L 9/04* (2006.01)
*A47L 9/00* (2006.01)

(52) U.S. Cl.
CPC ..... *A47L 9/0477* (2013.01); *A47L 9/0072* (2013.01); *A47L 9/02* (2013.01)

(58) Field of Classification Search
CPC ..... A47L 9/02; A47L 9/0072; A47L 9/0477
USPC ..... 15/419, 421
See application file for complete search history.

(56) References Cited

U.S. PATENT DOCUMENTS

| | | | |
|---|---|---|---|
| 2002/0133902 | A1 | 9/2002 | Vanderlinden |
| 2002/0133903 | A1 | 9/2002 | Vanderlinden |

FOREIGN PATENT DOCUMENTS

| | | |
|---|---|---|
| CA | 2376220 | 9/2003 |
| DE | 862 654 | 1/1953 |
| DE | 10 2004 005 144 | 8/2005 |
| EP | 1077290 | 2/2001 |
| EP | 2098150 | 9/2009 |
| GB | 2 419 278 | 4/2006 |

(Continued)

OTHER PUBLICATIONS

Combined Search and Examination Report dated Jul. 29, 2015, directed to GB Application No. 1503858.1; 2 pages.

(Continued)

*Primary Examiner* — David Redding
(74) *Attorney, Agent, or Firm* — Morrison & Foerster LLP

(57) ABSTRACT

A suction nozzle for a vacuum cleaner, the suction nozzle comprising a suction chamber, an outlet duct extending from the suction chamber for connection to a vacuum source on the vacuum cleaner, a soleplate for supporting the nozzle on a carpeted floor, a suction opening in the soleplate which opens into the suction chamber, and a valve which can be manually operated to open or close a bleed path through the front of the nozzle into the suction chamber, the bleed path being defined by a channel formed on the underside of the soleplate which is fluidly connected to the outlet duct, the channel terminating in an entrance slot on the front of the nozzle for admitting debris as the suction nozzle is pushed in a forward direction, the channel defining a throat downstream of the entrance slot, the throat having a smaller cross-sectional area than the entrance slot.

13 Claims, 5 Drawing Sheets

(56) References Cited

FOREIGN PATENT DOCUMENTS

| | | |
|---|---|---|
| JP | 57-145354 | 9/1982 |
| JP | 60-33948 | 3/1985 |
| JP | 63-181724 | 7/1988 |
| JP | 1-181826 | 7/1989 |
| JP | 2-19122 | 1/1990 |
| JP | 4-197224 | 7/1992 |
| JP | 5-21852 | 3/1993 |
| JP | 6-30129 | 8/1994 |
| JP | 9-10147 | 1/1997 |
| JP | 2002-512 | 1/2002 |
| JP | 2002-65523 | 3/2002 |
| JP | 2005-169065 | 6/2005 |
| KR | 10-2001-0037742 | 5/2001 |

OTHER PUBLICATIONS

International Search Report and Written Opinion dated Jun. 24, 2016, directed to International Application No. PCT/GB2016/050580; 10 pages.

SUCTION NOZZLE FOR A VACUUM CLEANER

REFERENCE TO RELATED APPLICATIONS

This application claims the priority of United Kingdom Application No. 1503858.1, filed Mar. 6, 2015, the entire contents of which are incorporated herein by reference.

FIELD OF THE INVENTION

The present invention relates to a suction nozzle for a vacuum cleaner.

The invention is not limited to suction nozzles for any particular type of vacuum cleaner. For example it includes both cleaner heads on upright vacuum cleaners and floor tools on cylinder vacuum cleaners or handheld vacuum cleaners.

BACKGROUND OF THE INVENTION

One way of characterizing the cleaning performance of a vacuum cleaner is by reference to its so-called "pick-up" performance: the ability of the vacuum cleaner to pick up dirt and debris from a floor surface.

A desirable pick-up performance often includes the ability to pick up both fine dirt as well as so-called "large debris" such as, for example, certain pet snacks, breakfast cereals, grains of rice etc.

The design of the suction nozzle on a vacuum cleaner is one of the factors which determines the ability of a vacuum cleaner to pick up large debris.

SUMMARY OF THE INVENTION

An object of the present invention is to seek to provide a new design of suction nozzle for a vacuum cleaner which is configured for picking up both fine dirt and large debris.

According to the invention there is provided a suction nozzle for a vacuum cleaner, the suction nozzle comprising a suction chamber, an outlet duct extending from the suction chamber for connection to a vacuum source on the vacuum cleaner, a soleplate for supporting the nozzle on a carpeted floor, a suction opening in the soleplate which opens into the suction chamber, and a valve which can be manually operated to open or close a bleed path through the front of the nozzle into the suction chamber, the bleed path being defined by a channel formed on the underside of the soleplate which is fluidly connected to the outlet duct, the channel terminating in an entrance slot on the front of the nozzle for admitting debris as the suction nozzle is pushed in a forward direction, the channel defining a throat downstream of the entrance slot, the throat having a smaller cross-sectional area than the entrance slot.

The provision of an entrance slot on the front of the nozzle provides a large debris pick-up capability.

The throat downstream of the entrance slot provides a flow restriction in the bleed path for limiting the proportion of available flow drawn in through the bleed path in use of the vacuum cleaner, so that a greater proportion of the flow is instead drawn in through the main suction opening for effective fine dust pick-up. This makes possible a degree of independent optimization of both large debris pick-up—by specifying the width of the entrance slot—and also fine dust pick-up—by specifying the cross-sectional area of the throat.

In order to maximize fine dust pick-up, the nozzle incorporates a manual valve which can be used to close off the bleed path completely, in effect so that in use the entire flow through the suction nozzle is drawn in through the suction opening. This provides additional flexibility for the user if large-debris pick-up is not required.

The channel may incorporate a tapered section between the entrance slot and the throat, which tapers inwardly towards the throat. This tapered section preferably extends from the entrance slot to the throat, although this is not essential: instead only a shorter section of the channel in between the entrance slot and the throat may be tapered.

The inwardly tapered section of the channel advantageously funnels the debris inwards towards the throat.

The channel may be fluidly connected to the outlet duct via the suction chamber, so that the debris passes first into the main suction chamber, from where it is then ducted through the outlet duct. This is a relatively simple arrangement which does not require the provision of separate, parallel flow paths connecting the outlet duct to the suction chamber and the channel respectively. In a particular arrangement, the channel on the underside of the soleplate is merged with the suction opening to provide a straightforward and simple connection of the channel to the suction chamber.

The channel may form part of the valve or it may form part of the soleplate, or alternatively separate sections of the channel may form part of the soleplate and the valve, respectively.

The valve may comprise a valve member which is manually moveable between an open position in which the valve is open, and a closed position in which the valve is closed.

The channel—or at least part of the channel—may be formed by the valve member.

The valve member may be manually slidable between the open position and the closed position.

In one embodiment, the channel forms part of the soleplate and the valve member is a sliding shutter which can be moved between the open position, in which the channel is open, and the closed position, in which the shutter obstructs the channel. The sliding shutter is preferably positioned to obstruct the entrance slot, and preferably closes off the entrance slot so that debris is effectively prevented from entering the entrance slot.

In an alternative embodiment, the valve member is a sliding member which incorporates at least a section of the channel, the front wall of the suction chamber comprises an inlet and the valve member is manually slidable between an open position in which the channel section fluidly connects the entrance slot to the inlet in the front wall of the suction chamber, and a closed position in which the valve member obstructs the entrance slot.

The entrance slot is preferably positioned centrally on the suction nozzle, viewed from the front of the nozzle.

The suction nozzle may comprise an agitator inside the suction chamber for engaging and agitating the carpeted floor through the suction opening.

The entrance slot may be incorporated in a straight front edge of the cleaner head, which front edge preferably extends across the full width of the front of the suction nozzle.

An actuator is preferably provided externally on the suction nozzle for manual operation to move the valve between the open and closed positions. For example, if a sliding valve member is used, the actuator may be an external sliding handle fixed or operably connected to the sliding valve member. The sliding valve member itself may be housed internally inside the suction nozzle, in which case the external handle my project through a guide slot in an external wall of the suction nozzle.

In accordance with another aspect of the invention, there is also provided a vacuum cleaner incorporating the suction nozzle. The vacuum cleaner may be an upright vacuum cleaner.

BRIEF DESCRIPTION OF THE DRAWINGS

One or more embodiments of the invention will now be described with reference to the accompanying drawings, in which.

DETAILED DESCRIPTION OF THE INVENTION

FIGS. 1-4 illustrates a suction nozzle in the form of a cleaner head 1 for an upright vacuum cleaner. The remainder of the upright vacuum cleaner itself is not illustrated, and can be taken to be conventional.

Figure 1:
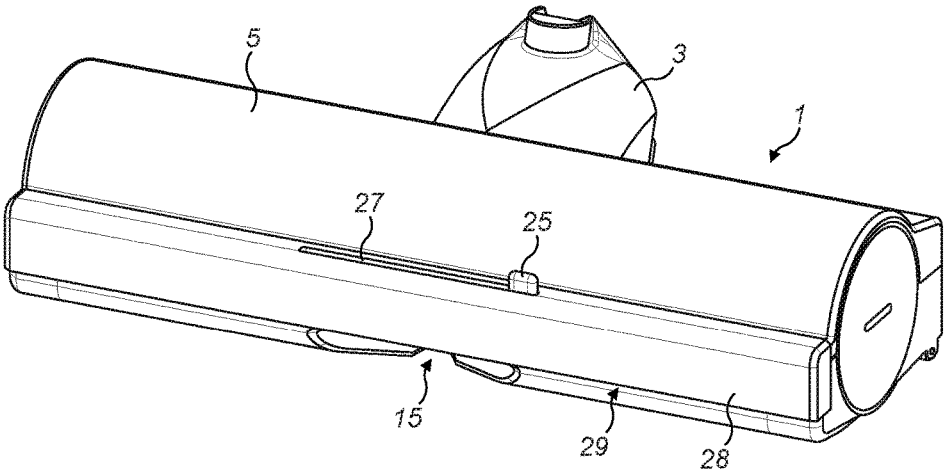
FIG. 1 is a perspective view showing a cleaner head for an upright vacuum cleaner (not illustrated), with the valve being open to define a bleed path through the front of the nozzle in accordance with the present invention.
Figure 2:
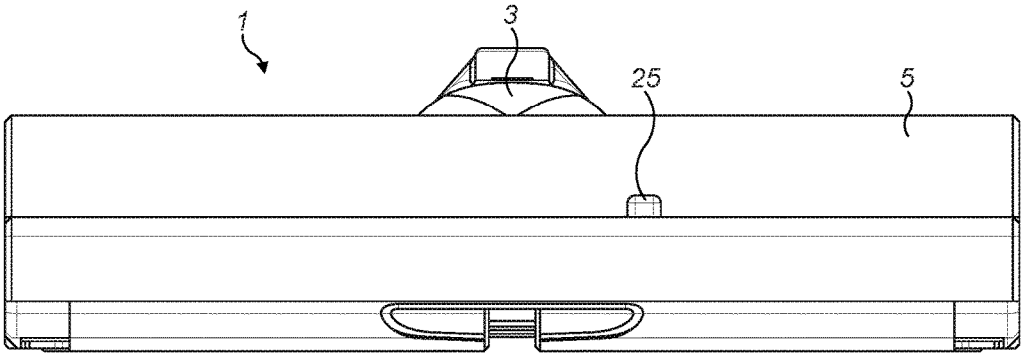
FIG. 2 is a front view of the cleaner head in FIG. 1.
Figure 3:
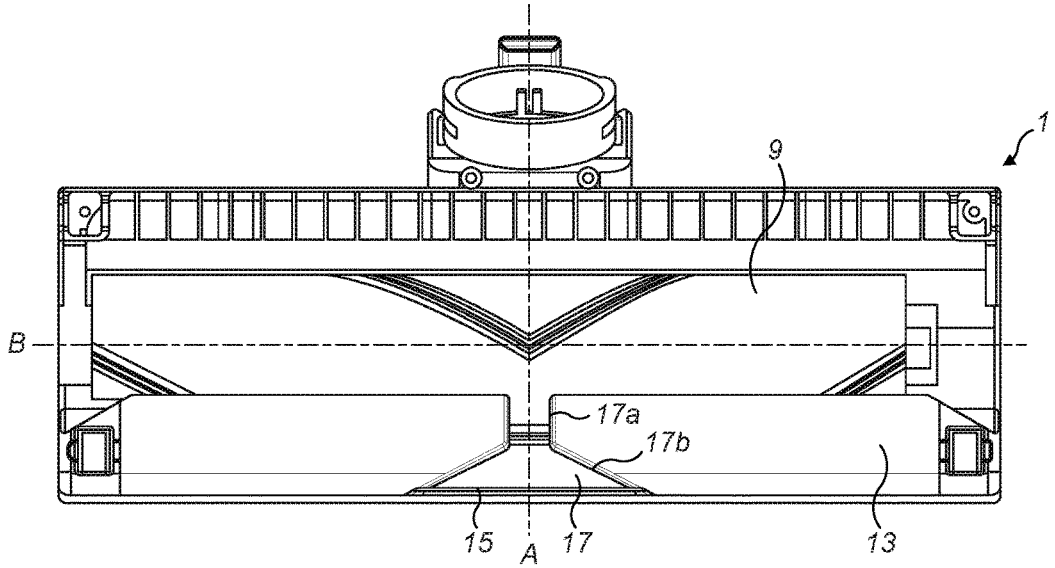
FIG. 3 is a plan view of the underside of the cleaner head in FIG. 1.
Figure 4:
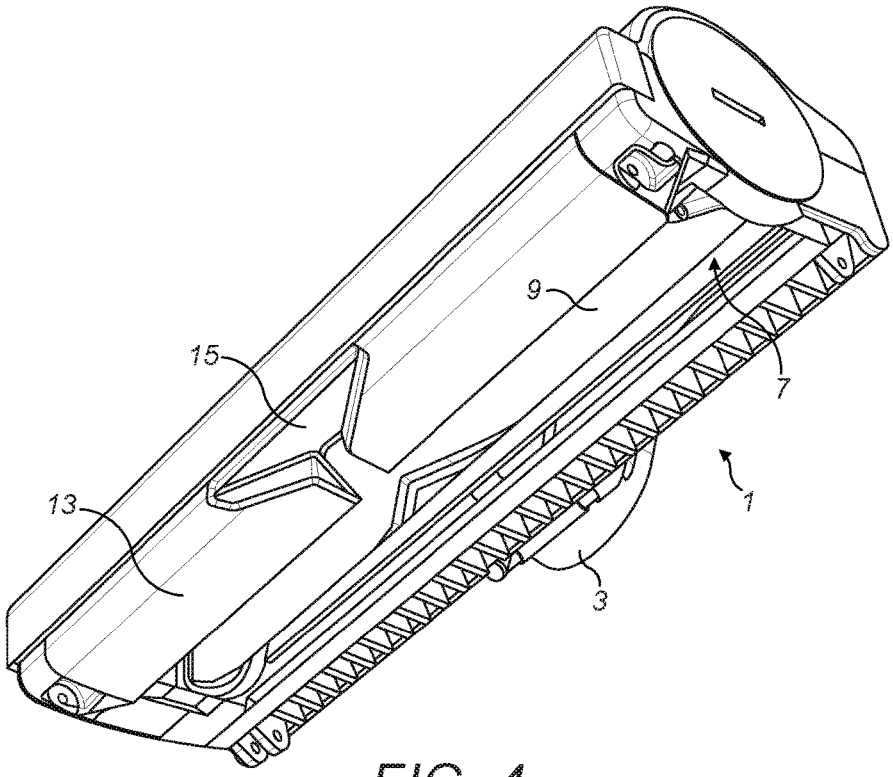
FIG. 4 is a perspective view showing the underside of the cleaner head in FIG. 1.

The cleaner head 1 comprises a rear neck portion 3 arranged along a centerline A of the cleaner head 1 and a roughly hemi-cylindrical head section 5 which extends perpendicular to the neck portion 3 along a transverse axis B, so that the cleaner head 1 is roughly the shape of an inverted "T" (see FIG. 3).

The rear neck portion 3 forms an outlet duct of the cleaner head 1 which is arranged for conventional connection to a suction inlet on the main body of the upright vacuum cleaner. This outlet duct connects to a hemi-cylindrical suction chamber 7 inside the head section 5 which houses an agitator in the form of a driven brush bar 9 rotatably mounted inside the suction chamber 7 along the transverse axis B. The brush bar 9 is mounted so that it protrudes through a rectangular suction opening 11 provided in a roughly rectangular soleplate 13 forming the flat underside of the hemi-cylindrical head section 5.

In use, the soleplate 13 engages a carpeted floor to form a working seal around the suction opening 11 and with suction applied to the outlet duct in the rear portion 3 the reduced head pressure inside the suction chamber 7 draws in dirt-laden air underneath the soleplate 13 (through the carpet fibres), through the suction opening 11, into the suction chamber 7 and out through the outlet duct in the rear neck portion 3.

The working seal is important for pick-up performance: an effective flow of dirt-laden air through the suction opening 11 requires an effective working seal around the suction opening 11. Nonetheless, it raises the problem that relatively large debris cannot pass underneath the soleplate 13: the debris is simply too large. In order therefore to provide a large debris pick-up capability, the cleaner head is provided with a valve which can be manually operated to open or close a bleed path through a relatively large entrance slot 15 on the front of the cleaner head 1.

The bleed path is defined by a channel 17 formed on the underside of the soleplate 13 which, when the valve is open as shown in FIGS. 1-4, connects the entrance slot 15 on the front of the cleaner head to an inlet 19 in the front wall 7*a* of the suction chamber 7 in such manner that the soleplate 13 also forms a working seal (against the carpet) around the channel 17.

The channel 17 comprises two sections: a rear section 17*a*, having the same cross sectional area as the inlet 19 and which defines a throat having a smaller cross sectional area than the entrance slot 15; and a tapered front section 17*b*, which tapers inwardly from the entrance slot 15 towards the rear section 17*a*.

In use, large debris is admitted through the entrance slot 15 on the front of the nozzle as the upright vacuum cleaner (and so the nozzle itself) is pushed in a forward direction. From here, the large debris is funneled through the channel 17 and towards the inlet 19 by the tapered front section 17*b*, passing via the rear section 17*a*.

The negative head pressure inside the suction chamber 7 acts on the channel 17 and so assists with large-debris pick-up. Nevertheless, the relatively small-area rear section 17*a*—defining the throat—provides a flow restriction in the bleed path to limit the proportion of the available airflow which is drawn in through the bleed path and to ensure that the majority flow is instead drawn through the suction opening 7. This makes possible a degree of independent optimization of both large debris pick-up: by specifying the width of the entrance slot 15 so that it presents a wide 'collection' area; and also fine dust pick-up: by specifying the cross-sectional area of the rear channel section 17*a* so that the majority of flow is directed through the suction opening 7.

In order to maximize fine dust pick-up, the valve can be closed to close off the bleed path completely, in effect so that in use the entire flow through the cleaner head 1 is drawn in through the suction opening 7. This provides additional flexibility for the user if large-debris pick-up is not required.

Figure 5:
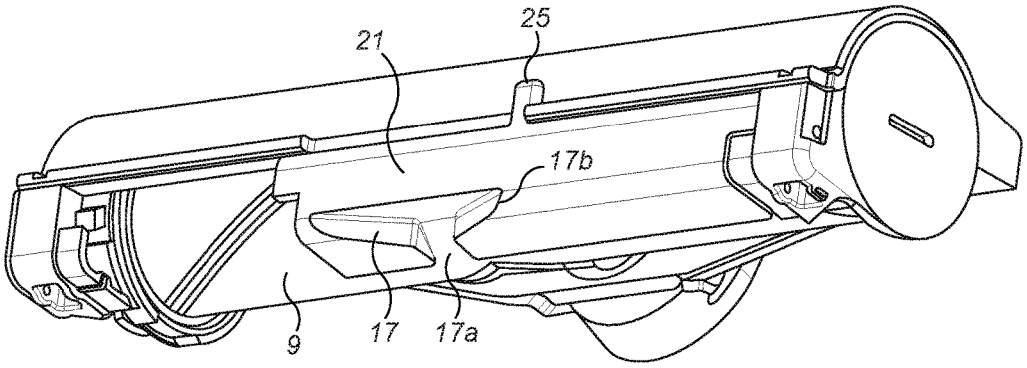
FIG. 5 is a perspective view of the cleaner head shown in FIGS. 1-4, but with the soleplate removed to illustrate the position of a sliding member when the valve is open.
Figure 6:
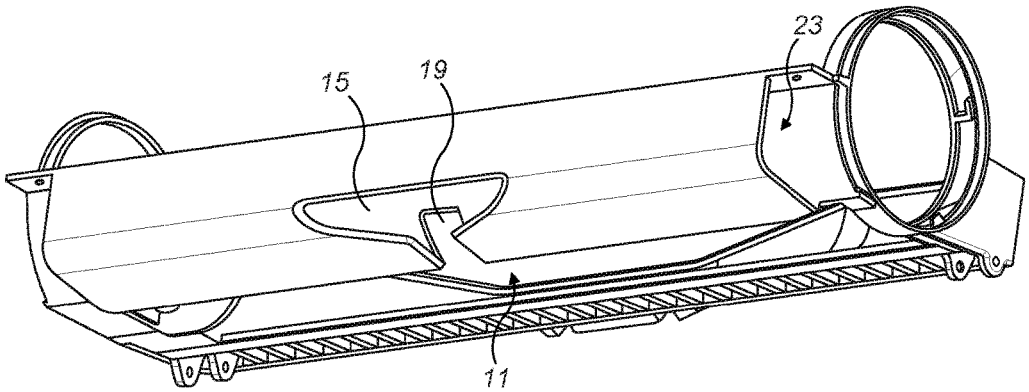
FIG. 6 is a front perspective view of the soleplate omitted from FIG. 5.
Figure 7:
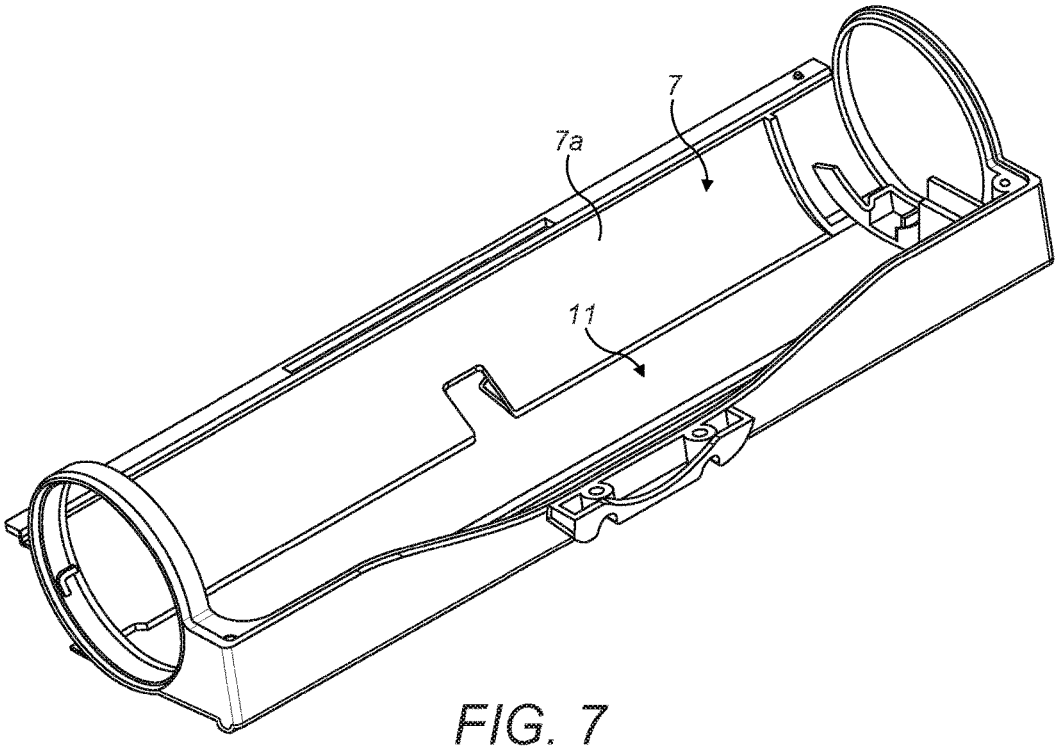
FIG. 7 is a rear perspective view of the soleplate omitted from FIG. 5.
Figure 8:
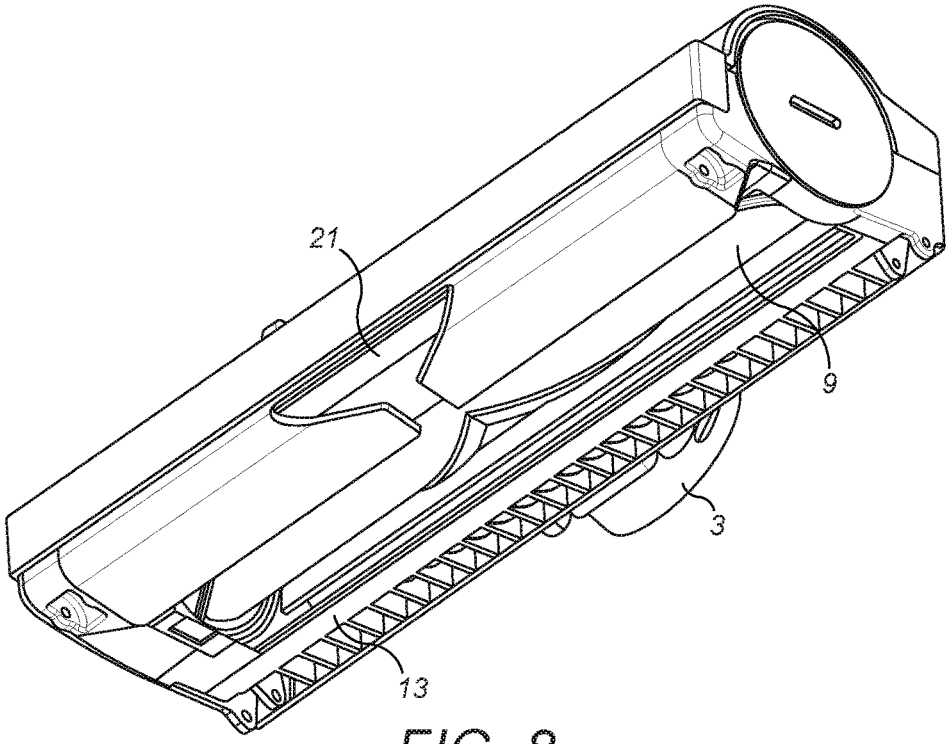
FIG. 8 is a perspective view illustrating the underside of the cleaner head shown in FIGS. 1-4, but with the valve closed in accordance with the invention.
Figure 9:
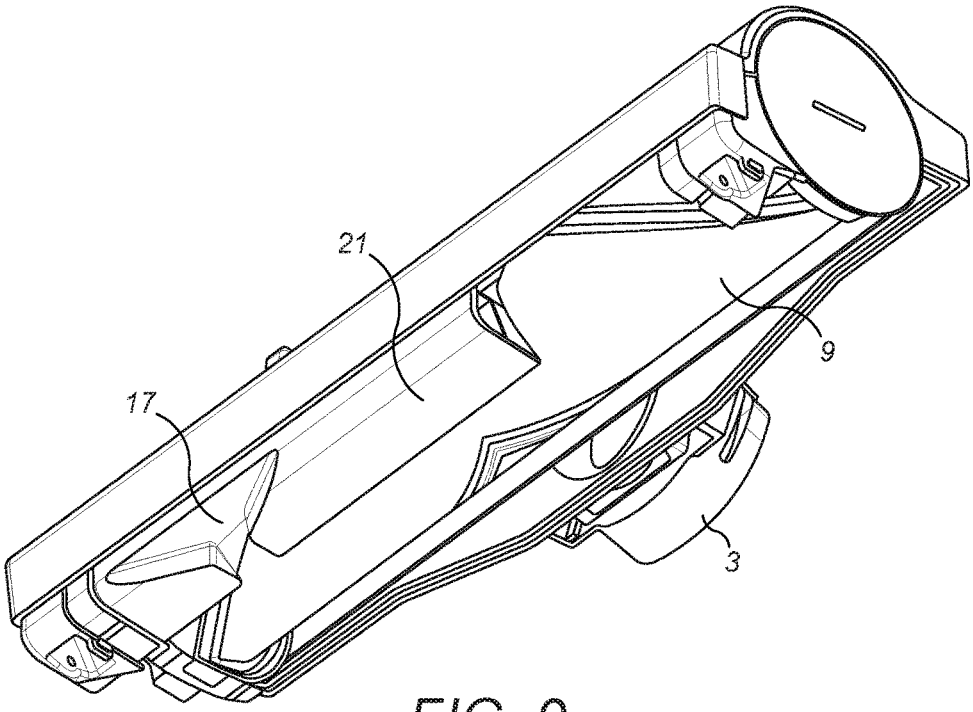
FIG. 9 is a perspective view corresponding to FIG. 8, but with the soleplate removed to illustrate the position of the sliding member when the valve is closed.

The valve is closed by means of an elongate sliding valve member 21 which defines the channel 17 between the entrance slot 15 and the inlet 19 and which is housed inside a transverse guide channel 23 running parallel to the transverse axis B, along the front of the cleaner head (see FIG. 6). The sliding valve member 21 is thus arranged to slide between an open position shown in FIG. 5—in which the channel 17 connects the entrance slot 15 to the inlet 19 (see also FIG. 1)—and a closed position shown in FIG. 9—in which the sliding valve member 21 obstructs the entrance slot 15 (see also FIG. 8) so that the valve (and so the bleed path through the front of the nozzle) is closed.

The sliding valve member 21 is manually operated by means of a slider handle 25 on the valve member which projects externally through an external guide slot 27 formed through a top part of a front bumper 28 of the head section 5.

The entrance slot 15 is positioned centrally on the cleaner head 1, when viewed from the front, and incorporated in a straight front edge 29 of the cleaner head 1 which extends across the full width of the cleaner head 1. The front of the cleaner head 1—and in particular the entrance slot—can thus be brought into close proximity to a wall or skirting so that the cleaner head can provide some additional "edge pick-up" near to walls, via the bleed path through entrance slot.

In an alternative embodiment (not shown), the channel may be defined by the soleplate itself rather than by the valve sliding member. In this arrangement the sliding valve member may take the form of a sliding shutter which can be moved between an open position in which the channel is open, and a closed position, in which the shutter obstructs the channel. For example, the sliding shutter may be positioned to obstruct the entrance slot in the closed position, or alternatively to obstruct the inlet to the suction chamber in the closed position.

It is not essential that the channel is connected to the outlet duct via the suction chamber. For example in an alternative embodiment (not shown), the channel may be connected to the outlet duct via a bypass duct which bypasses the suction chamber.

The sliding valve member is not essential, provided that the valve member is moveable between the open and closed positions. For example, a pivoting valve member may alternatively be provided.

The invention can similarly be implemented on other types of vacuum cleaner, for example as part of a floor tool for a cylinder vacuum cleaner or a handheld/stick vacuum cleaner.

The invention claimed is:

1. A suction nozzle for a vacuum cleaner, the suction nozzle comprising a suction chamber, an outlet duct extending from the suction chamber for connection to a vacuum source on the vacuum cleaner, a soleplate for supporting the nozzle on a carpeted floor, a suction opening in the soleplate which opens into the suction chamber, and a valve which can be manually operated to open or close a bleed path through the front of the nozzle, the bleed path being defined by a channel formed on the underside of the soleplate which is fluidly connected to the outlet duct, the channel terminating in an entrance slot on the front of the nozzle for admitting debris as the suction nozzle is pushed in a forward direction, the channel defining a throat downstream of the entrance slot, the throat having a smaller cross-sectional area than the entrance slot.

2. The suction nozzle of claim 1, wherein the channel incorporates a tapered section, between the entrance slot and the throat, which tapers inwardly towards the throat.

3. The suction nozzle of claim 1, wherein the channel is fluidly connected to the outlet duct via the suction chamber.

4. The suction nozzle of claim 3, wherein the channel on the underside of the soleplate is merged with the suction opening.

5. The suction nozzle of claim 1, in which the valve comprises a valve member which is manually moveable between an open position, in which the valve is open, and a closed position, in which the valve is closed.

6. The suction nozzle of claim 5, wherein at least a section of the channel is formed in the valve member.

7. The suction nozzle of claim 5, wherein the valve member is manually slidable between the open position and the closed position.

8. The suction nozzle of claim 7, in which the valve member is housed internally inside the suction nozzle and the valve member is manually slidable via a slider handle which projects externally through a guide slot in the top of the suction nozzle.

9. The suction nozzle of claim 7, wherein the valve member is a sliding member which incorporates at least a section of the channel, the front wall of the suction chamber comprises an inlet and the valve member is manually slidable between an open position in which the channel section fluidly connects the entrance slot to the inlet in the front wall of the suction chamber, and a closed position in which the valve member obstructs the entrance slot.

10. The suction nozzle of claim 1, in which the entrance slot is positioned centrally on the suction nozzle, viewed from the front of the nozzle.

11. The suction nozzle of claim 1, in which the entrance slot is incorporated in a straight front edge of the suction nozzle extending transversely across the full width of the suction nozzle.

12. The suction nozzle of claim 1, in which the nozzle comprises an agitator inside the suction chamber for engaging and agitating the carpeted floor through the suction opening.

13. A vacuum cleaner incorporating the suction nozzle of claim 1.

* * * * *